US011158924B2

(12) United States Patent
Li et al.

(10) Patent No.: US 11,158,924 B2
(45) Date of Patent: Oct. 26, 2021

(54) LTCC WIDE STOPBAND FILTERING BALUN BASED ON DISCRIMINATING COUPLING

(71) Applicant: SOUTH CHINA UNIVERSITY OF TECHNOLOGY, Guangdong (CN)

(72) Inventors: Yuanchun Li, Guangdong (CN); Disi Wu, Guangdong (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 0 days.

(21) Appl. No.: 16/627,761

(22) PCT Filed: Oct. 30, 2018

(86) PCT No.: PCT/CN2018/112816
§ 371 (c)(1),
(2) Date: Dec. 31, 2019

(87) PCT Pub. No.: WO2019/237638
PCT Pub. Date: Dec. 19, 2019

(65) Prior Publication Data

US 2021/0167481 A1 Jun. 3, 2021

(30) Foreign Application Priority Data

Jun. 13, 2018 (CN) ..... 201810605066.1

(51) Int. Cl.
*H01P 5/10* (2006.01)
*H01Q 5/47* (2015.01)
(Continued)

(52) U.S. Cl.
CPC ..... *H01P 5/10* (2013.01); *H01P 1/202* (2013.01); *H01Q 5/47* (2015.01); *H01Q 9/0414* (2013.01); *H01Q 1/526* (2013.01)

(58) Field of Classification Search
CPC .. H01P 5/10; H01P 1/202; H01Q 5/47; H01Q 9/0414; H01Q 1/526
(Continued)

(56) References Cited

U.S. PATENT DOCUMENTS 7,795,995 B2 * 9/2010 White ..... H01P 1/2135 333/134
2003/0112184 A1 6/2003 Jenabi

FOREIGN PATENT DOCUMENTS

CN 102856620 1/2013
CN 103187603 7/2013
(Continued)

OTHER PUBLICATIONS

"International Search Report (Form PCT/ISA/210) of PCT/CN2018/112816", dated Feb. 27, 2019, with English translation thereof, pp. 1-5.
(Continued)

*Primary Examiner* — Robert J Pascal
*Assistant Examiner* — Kimberly E Glenn
(74) *Attorney, Agent, or Firm* — JCIPRNET

(57) ABSTRACT

The invention discloses a LTCC wide stopband filtering balun based on discriminating coupling. The filtering balun includes a dielectric, and a first resonator, a second resonator, a first feeding line, a second feeding line, a third feeding line and a metal ground which are arranged inside the dielectric. The two resonators are both half-wavelength resonators distributed on different layers, and the layers are connected through metal through holes. the first feeding line is coupled with a specific area of the first resonator for performing feeding to suppress a second harmonic, and the second feeding line and the third feeding line are coupled with a specific area of the second resonator for performing feeding to suppress a third harmonic, thus realizing a wide
(Continued)

stopband filtering performance. The second feeding line and the third feeding line are symmetrically arranged about a center of the second resonator, thus realizing a same-amplitude reverse-phase balun output characteristic. The LTCC wide stopband filtering balun based on discriminating coupling according to the invention can suppress the second harmonic and the third harmonic, and a LTCC multi-layer circuit technology used reduces a size of a filtering balun.

10 Claims, 7 Drawing Sheets

(51) Int. Cl.

| | |
|---|---|
| ***H01P 1/202*** | (2006.01) |
| ***H01Q 9/04*** | (2006.01) |
| ***H01Q 1/52*** | (2006.01) |

(58) Field of Classification Search
USPC ..... 333/25
See application file for complete search history.

(56) References Cited

FOREIGN PATENT DOCUMENTS

| | | |
|---|---|---|
| CN | 103915667 | 7/2014 |
| CN | 104241737 | 12/2014 |
| CN | 105337009 | 2/2016 |

OTHER PUBLICATIONS

Zhang, Xiaoping, et al., "Balanced Bandpass Filter Design with Improved Stopband Characteristic," Audio Engineering, vol. 36, Apr. 2012, pp. 25-28.

* cited by examiner

LTCC WIDE STOPBAND FILTERING BALUN BASED ON DISCRIMINATING COUPLING

CROSS-REFERENCE TO RELATED APPLICATION

This application is a 371 of international application of PCT application serial no. PCT/CN2018/112816, filed on Oct. 30, 2018, which claims the priority benefit of China application no. 201810605066.1, filed on Jun. 13, 2018. The entirety of each of the above mentioned patent applications is hereby incorporated by reference herein and made a part of this specification.

FIELD OF THE INVENTION

The present invention relates to the field of filtering baluns in radio-frequency circuits, and more particularly, to a LTCC wide stopband filtering balun based on discriminating coupling, which can be used in differential antenna feeding and a differential amplifier circuit.

DESCRIPTION OF RELATED ART

With the rapid development of a modern wireless communication system, trends of miniaturization and multifunction of radio-frequency devices and modules are increasingly obvious. A balun and a bandpass filter are used as two important devices of a radio-frequency circuit, and often need to be used in a cascade way, and the miniaturization of the whole circuit is particularly important. On one hand, a fusion design of a filtering balun integrates functions of the two important devices, so that the module is multifunctional, and on the other hand, performance deterioration caused by cascade mismatch is avoided, and meanwhile, overall volume of the module is reduced. Relevant researches for the filtering baluns based on a dielectric resonator (DR), a substrate integrated waveguide (SIW) and planar printed circuit board (PCB) technology have been conducted, but the filtering baluns are usually large in volume. Therefore, a low-temperature co-fired ceramic (LTCC) technology with advantages of low cost, low insertion loss and high frequency performance is used to design filtering baluns to reduce a device volume. However, most of them only focus on a passband performance, and an out-of-band performance is deteriorated due to the existence of harmonics.

At present, few researches seek to improve a stopband performance of the filtering balun. Relevant methods proposed include using a capacitive load to move a harmonic, and using a cascade balun and a low-pass filter to suppress a harmonic, etc. However, they have problems of large structure volume, narrow suppression stopband, increased in-band insertion loss, deterioration of a balun characteristic output performance, etc.

BRIEF SUMMARY OF THE INVENTION

In order to overcome at least one defect in the prior art, the present invention provides a LTCC wide stopband filtering balun based on discriminating coupling, which can suppress the second harmonic and the third harmonic. A low-temperature co-fired ceramic technology is used in the device, which reduces a volume of the filtering balun. A discriminating coupling technology is used to suppress the second harmonic and the third harmonic, thus realizing a filtering performance of a wide stopband. A symmetrical feeding technology is used to introduce two zeros on both sides of a pass band, thus increasing a selectivity of the passband. Good balun output is realized by using a reverse-phase characteristic of both ends of a half-wavelength resonator.

In order to solve the technical problems above, the technical solutions used in the present invention are as follows.

A LTCC wide stopband filtering balun based on discriminating coupling includes a dielectric, and a resonator, a feeding line and a metal ground which are arranged inside the dielectric, the resonator includes a resonator tail end, a feeding coupling area and a resonator mutual-coupling area which are sequentially arranged from top to bottom along an inside of the dielectric, the resonator tail end is connected to the feeding coupling area through a metal via hole, the feeding coupling area is connected to the resonator mutual-coupling area through the metal via hole, the feeding line is arranged between the resonator tail end and the feeding coupling area, the metal ground includes a first metal ground arranged at a top of the dielectric and a second metal ground arranged at a bottom of the dielectric, a third metal ground arranged between the resonator tail end and the feeding line, and a fourth metal ground arranged between the feeding coupling area and the resonator mutual-coupling area, and the third metal ground and the fourth metal ground are provided with through holes for the metal via io hole to pass through;

the resonator includes a first resonator and a second resonator; a feeding coupling area of a first resonator includes a feeding coupling area I and a feeding coupling area II, the feeding coupling area I and the feeding coupling area II are in left-right mirror symmetry; a feeding coupling area of a second resonator includes a feeding coupling area III and a feeding coupling area IV, and the feeding coupling area III and the feeding coupling area IV are in left-right mirror symmetry;

a sum of a length from a point on the feeding coupling area of the first resonator and perpendicularly corresponding to a center of the feeding line coupled with the feeding coupling area of the first resonator for performing feeding to one end at which the feeding coupling area of the first resonator is connected to a resonator tail end of the first resonator and a length of the resonator tail end of the first resonator is a quarter of an entire length of the first resonator, thus realizing suppression of a second hamionic by discriminating coupling;

a sum of a length from a point on the feeding coupling area of the second resonator and perpendicularly corresponding to a center of the feeding line coupled with the feeding coupling area of the second resonator for performing feeding to one end at which the feeding coupling area of the second resonator is connected to a resonator tail end of the second resonator and a length of the resonator tail end of the second resonator is one-sixth of an entire length of the second resonator, thus realizing suppression of a third harmonic by discriminating coupling.

Further, the dielectric includes a first dielectric layer, a second dielectric layer, a third dielectric layer, a fourth dielectric layer, a fifth dielectric layer, a sixth dielectric layer, a seventh dielectric layer and an eighth dielectric layer which are sequentially arranged from top to bottom, the resonator tail end of the first resonator and the resonator tail end of the second resonator are both arranged between the first dielectric layer and the second dielectric layer, the resonator tail end of the first resonator is arranged in front of the resonator tail end of the second resonator, the feeding coupling area of the first resonator and the feeding coupling area of the second resonator are both arranged between the fourth dielectric layer and the fifth dielectric layer, the feeding coupling area of the first resonator is arranged in front of the feeding coupling area of the second resonator, a resonator mutual-coupling area of the first resonator is arranged between the seventh dielectric layer and the eighth dielectric layer, and a resonator mutual-coupling area of the second resonator is arranged between the sixth dielectric layer and the seventh dielectric layer.

Further, the first resonator and the second resonator are both half-wavelength resonators, and good balun output is realized by using an equal-amplitude reverse-phase characteristic of a standing wave of the half-wavelength resonator.

Further, the third metal ground is arranged between the second dielectric layer and the third dielectric layer, and the fourth metal ground is arranged between the fifth dielectric layer and the sixth dielectric layer.

Further, the feeding line is arranged between the third dielectric layer and the fourth dielectric layer, the feeding line includes a first feeding line, a second feeding line and a third feeding line, the first feeding line, the second feeding line and the third feeding line have a same shape and a same length, the first feeding line and the second feeding line are in front-back mirror symmetry, thus generating zeros on both sides of a passband, and the second feeding line and the third feeding line are in left-right mirror symmetry.

Further, the first feeding line, the second feeding line and the third feeding line are each provided with a feeding port at a middle part thereof; and the first feeding line is coupled with the feeding coupling area of the first resonator in an broadside coupling feeding, and the second feeding line and the third feeding are coupled with the feeding coupling area of the second resonator in an broadside coupling feeding. Further, the resonator tail end of the first resonator includes the resonator tail end A and a resonator tail end B, the resonator tail end A and the resonator tail end B are in left-right mirror symmetry, and the resonator tail end of the second resonator includes a resonator tail end C and the resonator tail end D, the resonator tail end C and the resonator tail end D are in left-right mirror symmetry; and the feeding coupling area of the first resonator includes the feeding coupling area I and the feeding coupling area II, the feeding coupling area I and the feeding coupling area II are in left-right mirror symmetry, the first feeding line is coupled with the feeding coupling area I in an broadside coupling feeding, the feeding coupling area of the second resonator includes the feeding coupling area III and the feeding coupling area IV, the feeding coupling area III and the feeding coupling area IV are in left-right mirror symmetry, the second feeding line is coupled with the feeding coupling area III in an broadside coupling feeding, and the third feeding line is coupled with the feeding coupling area IV in an broadside coupling feeding.

Further, the resonator tail end A is connected to one end of the feeding coupling area I through the metal via hole, the other end of the feeding coupling area I is connected to one end of the resonator mutual-coupling area of the first resonator through the metal via hole, the other end of the resonator mutual-coupling area of the first resonator is connected to one end of the feeding coupling area II through the metal via hole, and the other end of the feeding coupling area II is connected to the resonator tail end B through the metal via hole to form the first resonator; and the resonator tail end C is connected to one end of the feeding coupling area III through the metal via hole, the other end of the feeding coupling area III is connected to one end of the resonator mutual-coupling area of the second resonator through the metal via hole, the other end of the resonator mutual-coupling area of the second resonator is connected to one end of the feeding coupling area IV through the metal via hole, and the other end of the feeding coupling area IV is connected to the resonator tail end D through the metal via hole to form the second resonator.

Further, a sum of a length from a point on the feeding coupling area I and perpendicularly corresponding to a center of the first feeding line to one end at which the feeding coupling area I is connected to the resonator tail end A and the length of the resonator tail end A is a quarter of the entire length of the first resonator.

Further, a sum of a length from a point on the feeding coupling area III and perpendicularly corresponding to a center of the second feeding line to one end at which the feeding coupling area III is connected to the resonator tail end C and the length of the resonator tail end C is one-sixth of the entire length of the second resonator, and a sum of a length from the point on the feeding coupling area IV and perpendicularly corresponding to a center of the third feeding line to one end at which the feeding coupling area IV is connected to the resonator tail end D and the length of the resonator tail end D is one-sixth of the entire length of the second resonator.

Compared with the prior art, the present invention has the following advantages and beneficial effects.

1. Filtering and balun functions are integrated in the same device, thus reducing an overall insertion loss of a circuit module.

2. Good balun output is realized by using the reverse-phase characteristic of the standing wave of the half-wavelength resonator.

3. The second harmonic and the third harmonic are suppressed based on the discriminating coupling, thus expanding a stopband range without additional components.

4. Symmetrical arrangement of the feeding lines generates two transmission zeros on both sides of the passband, thus improving a selectivity of the passband.

5. A LTCC multi-layer technology is used, thus effectively reducing a size of the filtering balun.

DETAILED DESCRIPTION OF THE INVENTION

The accompanying drawings are for the illustrative purpose only and cannot be construed as limiting the present invention. To better describe the embodiments, some parts can be omitted, enlarged or shrunk in the accompanying drawings, which does not represent the size of the actual product. It is understandable for those skilled in the art that some well-known structures in the accompanying drawings and the descriptions thereof may be omitted. The positional relationship illustrated in the accompanying drawings is for illustrative purpose only and cannot be construed as limiting the present invention.

Figure 1:
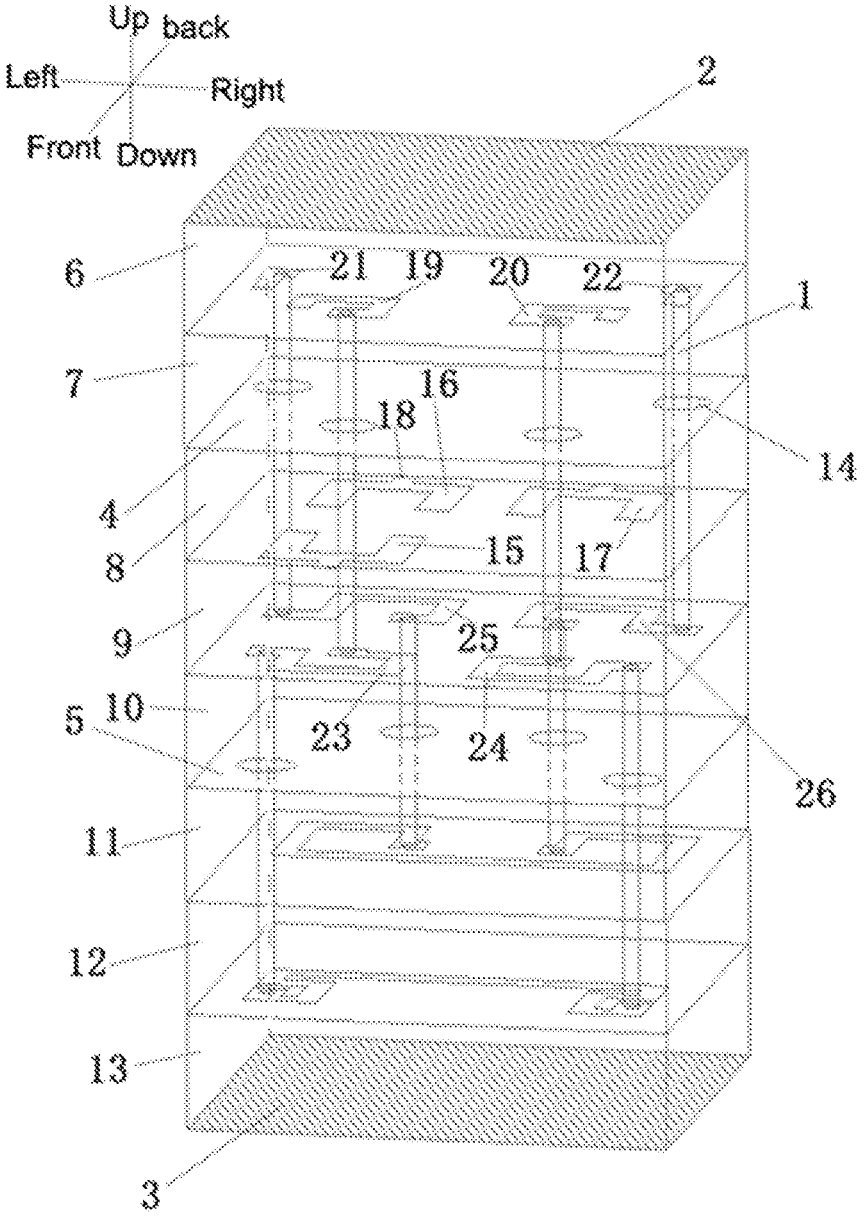
FIG. 1 is a hierarchical diagram of a stereoscopic structure according to the present invention.

As shown in FIG. 1, the embodiment of the present invention provides a LTCC wide stopband filtering balun based on discriminating coupling, which includes a dielectric, and a resonator, a feeding line and a metal ground which are arranged inside the dielectric, the dielectric includes a first dielectric layer 6, a second dielectric layer 7, a third dielectric layer 8, a fourth dielectric layer 9, a fifth dielectric layer 10, a sixth dielectric layer 11, a seventh dielectric layer 12 and an eighth dielectric layer 13 which are sequentially arranged from top to bottom, the resonator includes a first resonator and a second resonator which are both half-wavelength resonators, and good balun output is realized by using an equal-amplitude reverse-phase characteristic of a standing wave of the half-wavelength resonator. The first resonator and the second resonator each include a resonator tail end, a feeding coupling area and a resonator mutual-coupling area which are sequentially arranged from top to bottom along an inside of the dielectric, the resonator tail end is connected to the feeding coupling area through a metal via hole 1, the feeding coupling area is connected to the resonator mutual-coupling area through the metal via hole 1, the feeding line is arranged between the resonator tail end and the feeding coupling area, the metal ground includes a first metal ground 2 arranged at a top of the dielectric, a second metal ground 3 arranged at a bottom of the dielectric, a third metal ground 4 arranged between the resonator tail end and the feeding line, and a fourth metal ground 5 arranged between the feeding coupling area and the resonator mutual-coupling area, and the third metal ground 4 and the fourth metal ground 5 are provided with through holes 14 for the metal via hole 1 to pass through;

The resonator includes a first resonator and a second resonator; and a sum of a length from a point on the feeding coupling area of the first resonator and perpendicularly corresponding to a center of the feeding line coupled with the feeding coupling area of the first resonator for performing feeding to one end at which the feeding coupling area of the first resonator is connected to a resonator tail end of the first resonator and a length of the resonator tail end of the first resonator is a quarter of an entire length of the first resonator, thus realizing suppression of a second harmonic by discriminating coupling;

A sum of a length from a point on the feeding coupling area of the second resonator io that perpendicularly corresponds to a center of the feeding line coupled with the feeding coupling area of the second resonator for performing feeding to one end of the feeding coupling area of the second resonator connected to a resonator tail end of the second resonator, and a length of the resonator tail end of the second resonator is one-sixth of an entire length of the second resonator, thus realizing suppression of a third harmonic by discriminating coupling.

Figure 2:
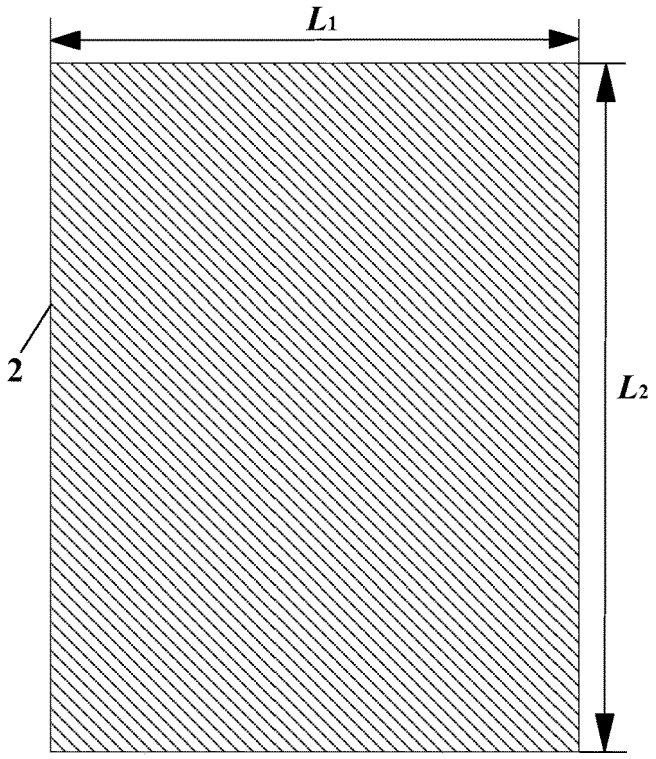
FIG. 2 is a top view of a first metal ground layer according to the present invention.

As shown in FIG. 2, this layer is a first metal ground layer in the embodiment, and is located at the top of the dielectric.

Figure 3:
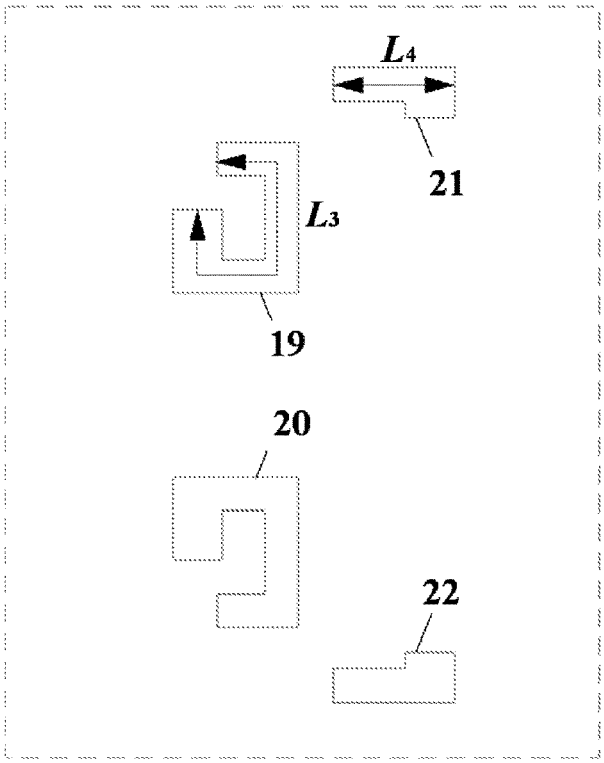
FIG. 3 is a top view of a resonator tail end layer according to the present invention.

As shown in FIG. 3, this layer is a resonator tail end area in the embodiment, is located between the first dielectric layer 6 and the second dielectric layer 7, and includes a resonator tail end of the first resonator and a resonator tail end of the second resonator.

The resonator tail end of the first resonator is arranged to the left of the resonator tail end of the second resonator, wherein the resonator tail end of the first resonator includes a resonator tail end A19 and a resonator tail end B20, the resonator tail end A19 and the resonator tail end B20 are in mirror symmetry, the resonator tail end of the second resonator includes a resonator tail end C21 and a resonator tail end D22, and the resonator tail end C21 and the resonator tail end D22 are in mirror symmetry.

Figure 4:
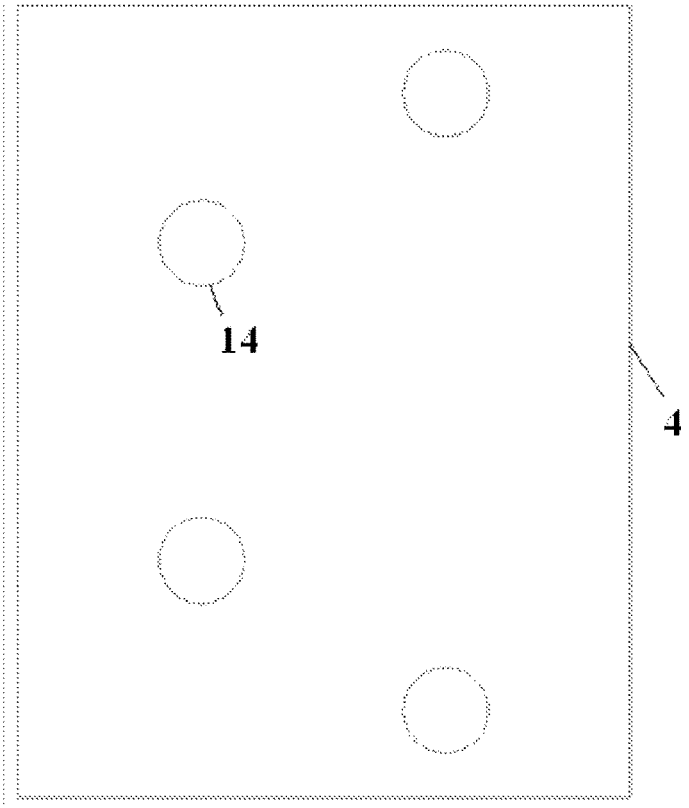
FIG. 4 is a top view of a third metal ground layer according to the present invention.
Figure 5:
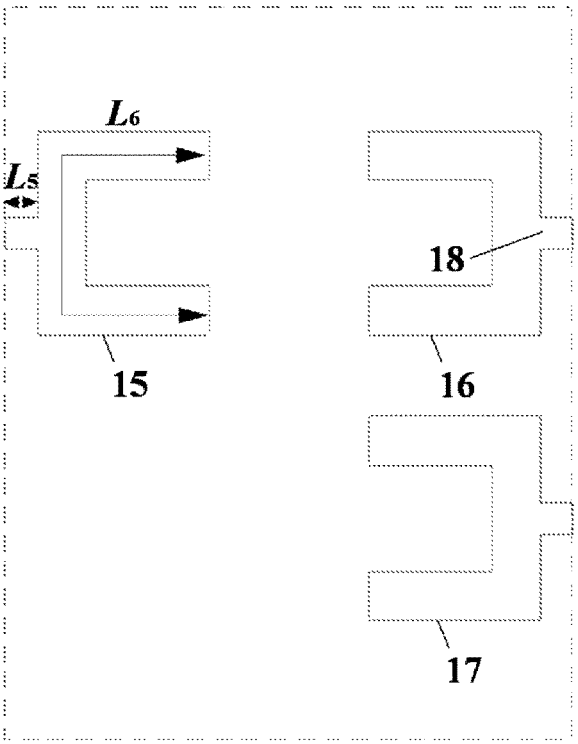
FIG. 5 is a top view of a feeding line layer according to the present invention.

As shown in FIG. 4, this layer is a third metal ground layer 4 in the embodiment, and is arranged between the second dielectric layer 7 and the third dielectric layer 8. As shown in FIG. 5, this layer is a feeding layer in the embodiment, and is arranged between the third dielectric layer 8 and the fourth dielectric layer 9. The feeding line includes a first feeding line 15, a second feeding line 16 and a third feeding line 17, the first feeding line 15, the second feeding line 16 and the third feeding line 17 have a same shape and a same length, the first feeding line 15, the second feeding line 16 and io the third feeding line 17 are each provided with a feeding port 18 at a middle part thereof, the first feeding line 15 and the second feeding line 16 are in mirror symmetry, thus generating zeros on both sides of a pass band, and the second feeding line 16 and the third feeding line 17 are in mirror symmetry.

Figure 6:
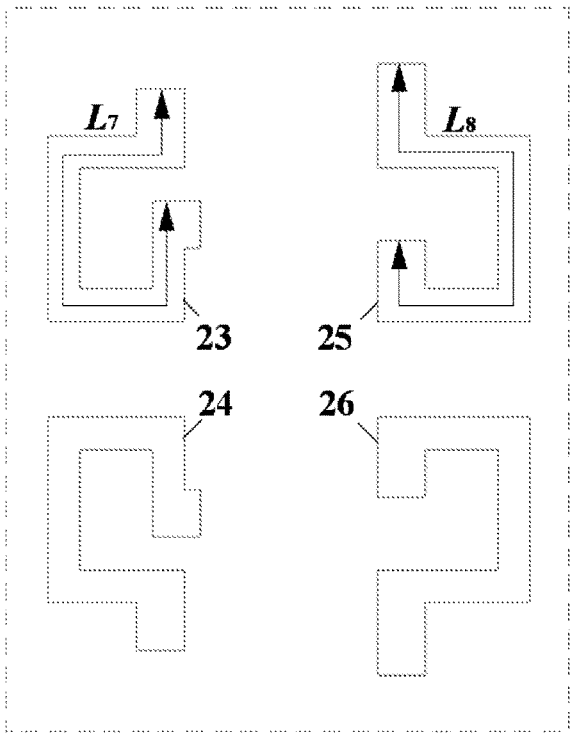
FIG. 6 is a top view of a feeding coupling area layer according to the present invention.

As shown in FIG. 6, this layer is a feeding coupling area layer in the embodiment, and is arranged between the fourth dielectric layer 9 and the fifth dielectric layer 10. A feeding coupling area of the first resonator is arranged to the left of a feeding coupling area of the second resonator, the feeding coupling area of the first resonator includes a feeding coupling area I23 and a feeding coupling area II24, the feeding coupling area I23 and the feeding coupling area II24 are in mirror symmetry, and the first feeding line 15 is coupled with the feeding coupling area 123 in an broadside coupling feeding. The feeding coupling area of the second resonator includes a feeding coupling area III25 and a feeding coupling area IV26, the feeding coupling area III25 and the feeding coupling area IV26 are in mirror symmetry, the second feeding line 16 is coupled with the feeding coupling area III25 in an broadside coupling feeding, and the third feeding line 17 is coupled with the feeding coupling area IV26 in an broadside coupling feeding. A sum of a length from a point on the feeding coupling area I23 and perpendicularly corresponding to a center of the first feeding line 15 to one end at which the feeding coupling area I23 is connected to the resonator tail end A19 and the length of the resonator tail end A19 is a quarter of the entire length of the first resonator, thus forming suppression of a second harmonic by discriminating coupling. A sum of a length from a point on the feeding coupling area III25 and perpendicularly corresponding to a center of the second feeding line 16 to one end at which the feeding coupling area III25 is connected to a resonator tail end C21 and a length of the resonator tail end C21 is one-sixth of an entire length of the second resonator, and a sum of a length from a point on the feeding coupling area IV26 and perpendicularly corresponding to a center of the third feeding line 17 to one end at which the feeding coupling area IV26 is connected to a resonator tail end D22 and a length of the resonator tail end D22 is one-sixth of the entire length of the second resonator, thus forming suppression of a third harmonic by discriminating coupling.

Figure 7:
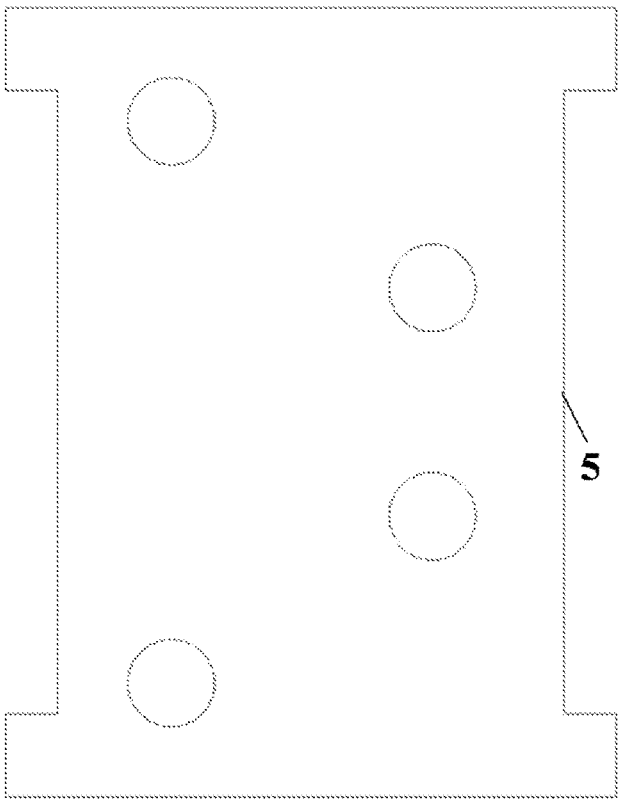
FIG. 7 is a top view of a fourth metal ground layer according to the present invention.

As shown in FIG. 7, this layer is a fourth metal ground layer 5 in the embodiment, and is arranged between the fifth dielectric layer 10 and the sixth dielectric layer 11.

Figure 8:
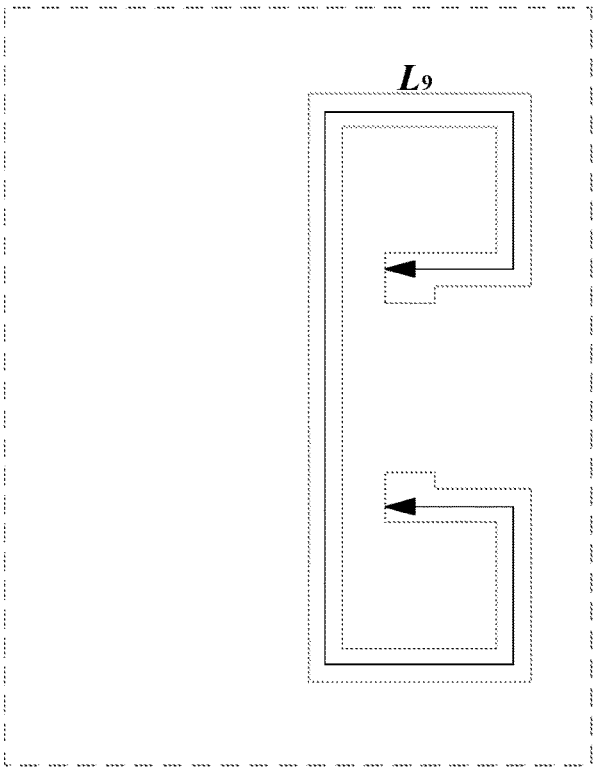
FIG. 8 is a top view of a resonator mutual-coupling area layer of a second resonator according to the present invention.

As shown in FIG. 8, this layer is a resonator mutual-coupling area layer of the second resonator in the embodiment, and is arranged between the sixth dielectric layer 11 and the seventh dielectric layer 12.

Figure 9:
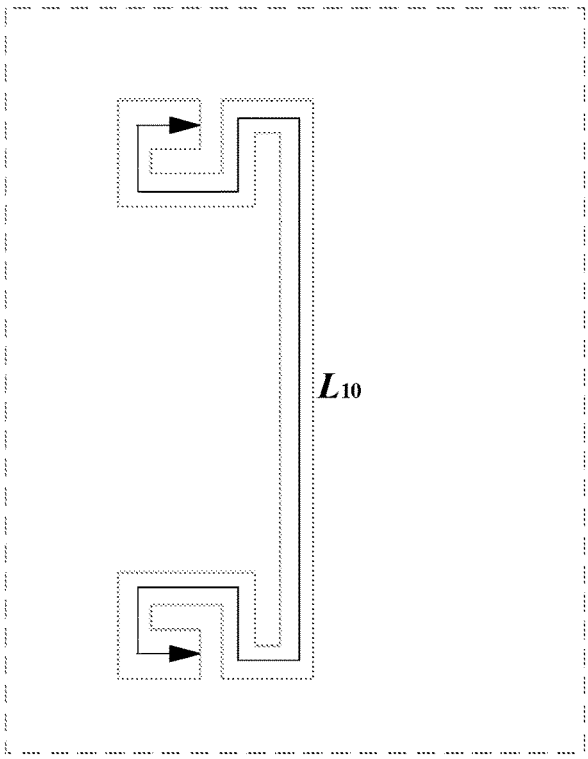
FIG. 9 is a top view of a resonator mutual-coupling area layer of a first resonator according to the present invention.

As shown in FIG. 9, this layer is a resonator mutual-coupling area layer of the first resonator in the embodiment, and is arranged between the seventh dielectric layer 12 and the eighth dielectric layer 13.

Figure 10:
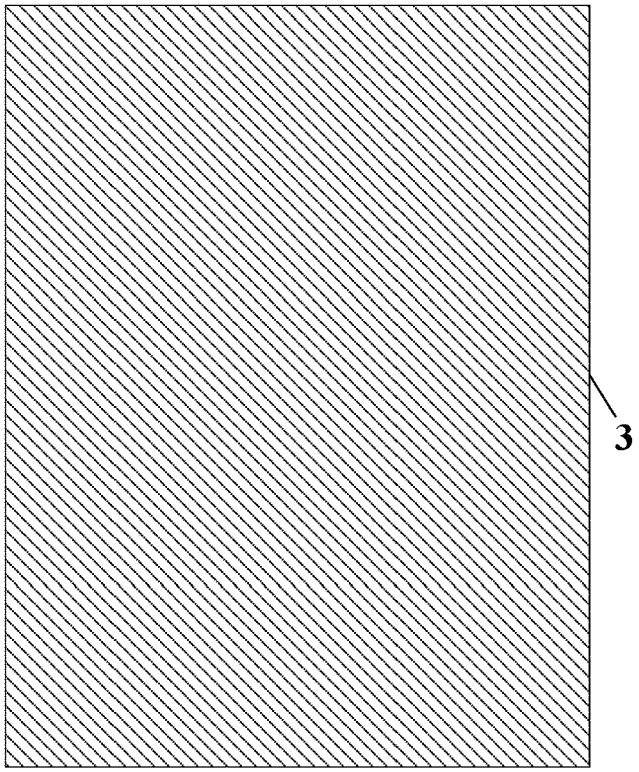
FIG. 10 is a top view of a second metal ground according to the present invention.

As shown in FIG. 10, this layer is a second metal ground layer in the embodiment, and is located at the bottom of the dielectric.

Various parameters of the embodiment are described as follows: As shown in FIG. 1 to FIG. 10, the first metal ground layer has a width L1 of 3.59 mm and a length L2 of 4.2 mm, the resonator tail end A has a length L3 of 2.03 mm, the resonator tail end C has a length L4 of 0.73 mm, the first feeding line has a middle branch L5 of 0.25 mm and a microstrip line L6 of 2.75 mm, the feeding coupling area I23 has a feeding length L7 of 3.35 mm, the feeding coupling area III25 has a feeding length L8 of 3.4 mm, the resonator mutual-coupling area layer of the second resonator has a microstrip line with a length L9 of 8.98 mm, the resonator mutual-coupling area layer of the first resonator has a length L10 of 6.3 mm, and each layer has a dielectric thickness of 0.1 mm. A conductor layer is made of metallic silver, and a dielectric substrate is ceramic, with a relative dielectric constant of 5.9, a dielectric loss tangent of 0.002, and a circuit volume of 4.2 mm*3.59 mm*1.6 mm.

Figure 11:
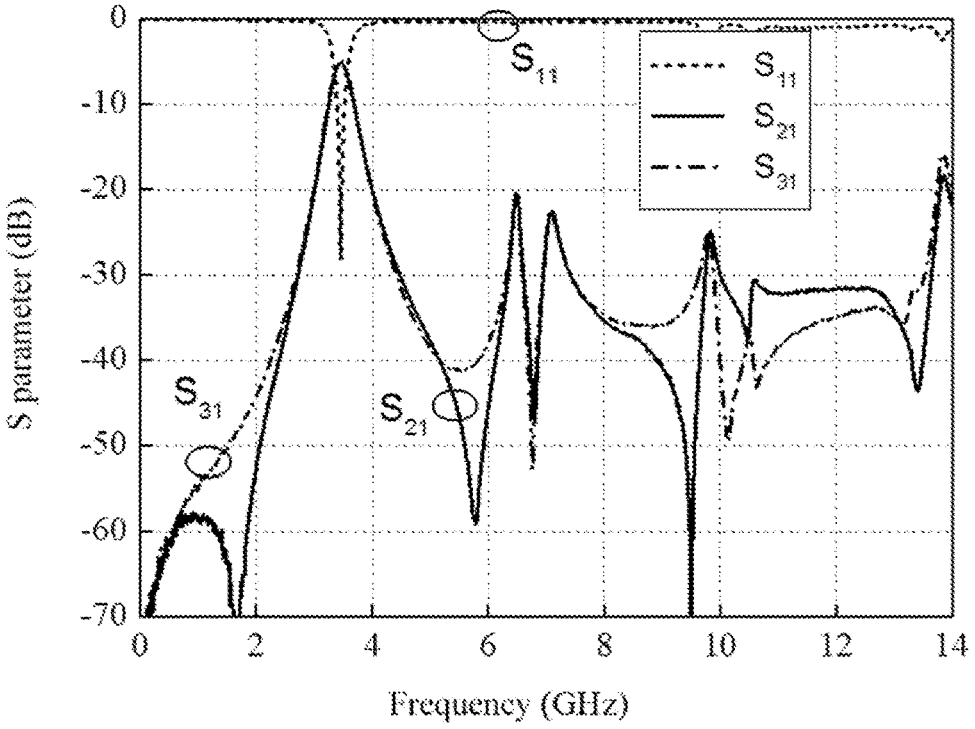
FIG. 11 is a measured curve graph of an S parameter response of an embodiment of a LTCC wide stopband filtering balun according to the present invention.

Measured results of an S parameter response are shown in FIG. 11, which includes three curves, S11, S21 and S31. The filtering balun has a center frequency of 3.4 GHz, a minimum insertion loss of 3+1.8 dB, and a return loss in a passband of about 28 dB. For a port 2, upper and lower side frequencies of the passband each have a transmission zero, thus improving a selectivity of the passband. An out-of-band suppression level of over 20 dB is realized between 4 GHz and 13.8 GHz, which shows that the filtering balun has a very good wide stopband filtering performance.

Figure 12:
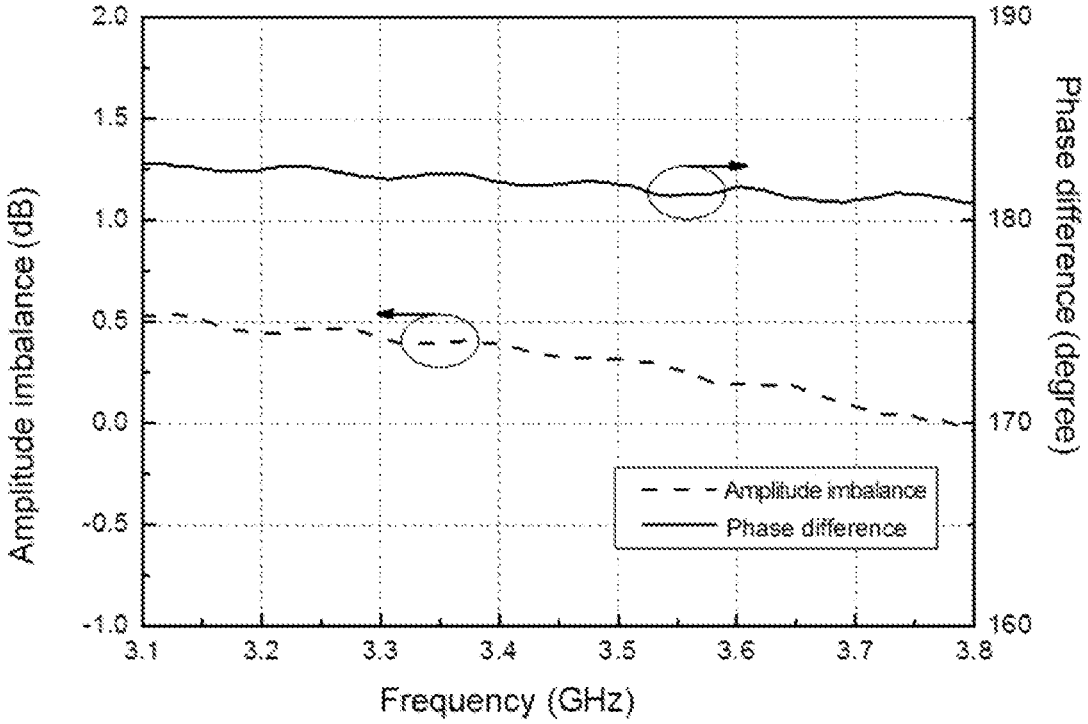
FIG. 12 is a measured curve graph of a balun characteristic response of an embodiment of the LTCC wide stopband filtering balun according to the present invention.

Measured results of a balun characteristic response are shown in FIG. 12, which includes two curves of an amplitude imbalance and a phase difference. An amplitude imbalance in a 3 dB passband of the filtering balun is less than 0.5 dB, and a phase difference ranges from 181.3° to 182.7°, which shows that the filtering balun has good balun characteristic output.

In summary, the present invention provides the LTCC wide stopband filtering balun using a discriminating coupling structure between the feeding lines and the resonators to suppress the second harmonic and the third harmonic; and the circuit has advantages of small volume, low insertion loss and wide stopband, can be processed into a patch element, is easy to integrate with other circuit module, and can be widely applied in a radio-frequency front end of a wireless communication system.

Obviously, the above embodiments of the present invention are only examples for clearly describing the present invention, and do not limit the embodiments of the present invention. For those having ordinary skills in the art, other different forms of changes or variations can also be made on the basis of the description above. All implementations need not and cannot be exhaustive here. All modifications, equivalents, and improvements made within the spirit and principle of the present invention shall be included within the scope of protection of the claims of the present invention.

What is claimed is:

1. A LTCC wide stopband filtering balun based on discriminating coupling, comprising a dielectric, and a resonator, a feeding line and a metal ground which are arranged inside the dielectric, wherein the resonator comprises a resonator tail end, a feeding coupling area and a resonator mutual-coupling area which are sequentially arranged from top to bottom along an inside of the dielectric, the resonator tail end is connected to the feeding coupling area through a metal via hole, the feeding coupling area is connected to the resonator mutual-coupling area through the metal via hole, the feeding line is arranged between the resonator tail end and the feeding coupling area, the metal ground comprises a first metal ground arranged at a top of the dielectric, a second metal ground arranged at a bottom of the dielectric, a third metal ground arranged between the resonator tail end and the feeding line, and a fourth metal ground arranged between the feeding coupling area and the resonator mutual-coupling area, and the third metal ground and the fourth metal ground are provided with through holes for the metal via hole to pass through;

the resonator comprises a first resonator and a second resonator; a feeding coupling area of the first resonator comprises a feeding coupling area I and a feeding coupling area II, the feeding coupling area I and the feeding coupling area II are in left-right mirror symmetry; a feeding coupling area of the second resonator comprises a feeding coupling area III and a feeding coupling area IV, and the feeding coupling area III and the feeding coupling area IV are in left-right mirror symmetry;

a sum of a length from a point on the feeding coupling area I of the first resonator and perpendicularly corresponding to a center of the feeding line coupled with the feeding coupling area I of the first resonator for performing feeding to one end at which the feeding coupling area I of the first resonator is connected to a resonator tail end A of the first resonator and a length of the resonator tail end A of the first resonator is a quarter of an entire length of the first resonator; and a sum of a length from a point on the feeding coupling area III of the second resonator and perpendicularly corresponding to a center of the feeding line coupled with the feeding coupling area III of the second resonator for performing feeding to one end at which the feeding coupling area III of the second resonator is connected to a resonator tail end C of the second resonator and a length of the resonator tail end C of the second resonator is one-sixth of an entire length of the second resonator; and a sum of a length from a point on the feeding coupling area IV of the second resonator and perpendicularly corresponding to a center of the feeding line coupled with the feeding coupling area IV of the second resonator for performing feeding to one end at which the feeding coupling area IV of the second resonator is connected to a resonator tail end D of the second resonator and a length of the resonator tail end D of the second resonator is one-sixth of the entire length of the second resonator.

2. The LTCC wide stopband filtering balun based on discriminating coupling according to claim 1, wherein the dielectric comprises a first dielectric layer, a second dielectric layer, a third dielectric layer, a fourth dielectric layer, a fifth dielectric layer, a sixth dielectric layer, a seventh dielectric layer and an eighth dielectric layer which are sequentially arranged from top to bottom, the resonator tail end of the first resonator and the resonator tail end of the second resonator are both arranged between the first dielectric layer and the second dielectric layer, the resonator tail end of the first resonator is arranged in front of the resonator tail end of the second resonator, the feeding coupling area of the first resonator and the feeding coupling area of the second resonator are both arranged between the fourth dielectric layer and the fifth dielectric layer, the feeding coupling area of the first resonator is arranged in front of the feeding coupling area of the second resonator, a resonator mutual-coupling area of the first resonator is arranged between the seventh dielectric layer and the eighth dielectric layer, and a resonator mutual-coupling area of the second resonator is arranged between the sixth dielectric layer and the seventh dielectric layer.

3. The LTCC wide stopband filtering balun based on discriminating coupling according to claim 2, wherein the first resonator and the second resonator are both half-wavelength resonators.

4. The LTCC wide stopband filtering balun based on discriminating coupling according to claim 2, wherein the third metal ground is arranged between the second dielectric layer and the third dielectric layer, and the fourth metal ground is arranged between the fifth dielectric layer and the sixth dielectric layer.

5. The LTCC wide stopband filtering balun based on discriminating coupling according to claim 2, wherein the feeding line is arranged between the third dielectric layer and the fourth dielectric layer, the feeding line comprises a first feeding line, a second feeding line and a third feeding line, the first feeding line, the second feeding line and the third feeding line have a same shape and a same length, the first feeding line and the second feeding line are in front-back mirror symmetry, and the second feeding line and the third feeding line are in left-right mirror symmetry.

6. The LTCC wide stopband filtering balun based on discriminating coupling according to claim 5, wherein the first feeding line, the second feeding line and the third feeding line are each provided with a feeding port at a middle part thereof; and the first feeding line is coupled with the feeding coupling area of the first resonator in an broadside coupling feeding, and the second feeding line and the third feeding line are coupled with the feeding coupling area of the second resonator in an broadside coupling feeding.

7. The LTCC wide stopband filtering balun based on discriminating coupling according to claim 6, wherein the resonator tail end of the first resonator comprises the resonator tail end A and a resonator tail end B, the resonator tail end A and the resonator tail end B are in left-right mirror symmetry, and the resonator tail end of the second resonator comprises a resonator tail end and the resonator tail end D, the resonator tail end C and the resonator tail end D are in left-right mirror symmetry; and the first feeding line is coupled with the feeding coupling area I in an broadside coupling feeding, the second feeding line is coupled with the feeding coupling area III in an broadside coupling feeding, and the third feeding line is coupled with the feeding coupling area IV in an broadside coupling feeding.

8. The LTCC wide stopband filtering balun based on discriminating coupling according to claim 7, characterized in that, wherein the resonator tail end A is connected to one end of the feeding coupling area I through the metal via hole, the other end of the feeding coupling area I is connected to one end of the resonator mutual-coupling area of the first resonator through the metal via hole, the other end of the resonator mutual-coupling area of the first resonator is connected to one end of the feeding coupling area II through the metal via hole, and the other end of the feeding coupling area II is connected to the resonator tail end B through the metal via hole to form the first resonator; and the resonator tail end C is connected to one end of the feeding coupling area III through the metal via hole, the other end of the feeding coupling area III is connected to one end of the resonator mutual-coupling area of the second resonator through the metal via hole, the other end of the resonator mutual-coupling area of the second resonator is connected to one end of the feeding coupling area IV through the metal via hole, and the other end of the feeding coupling area IV is connected to the resonator tail end D through the metal via hole to form the second resonator.

9. The LTCC wide stopband filtering balun based on discriminating coupling according to claim 7, wherein a sum of a length from a point on the feeding coupling area I and perpendicularly corresponding to a center of the first feeding line to one end at which the feeding coupling area I is connected to the resonator tail end A and the length of the resonator tail end A is a quarter of the entire length of the first resonator.

10. The LTCC wide stopband filtering balun based on discriminating coupling according to claim 7, wherein a sum of a length from a point on the feeding coupling area III and perpendicularly corresponding to a center of the second feeding line to one end at which the feeding coupling area III is connected to the resonator tail end C and the length of the resonator tail end C is one-sixth of the entire length of the second resonator; and a sum of a length from a point on the feeding coupling area IV and perpendicularly corresponding to a center of the third feeding line to one end at which the feeding coupling area IV is connected to the resonator tail end D and the length of the resonator tail end D is one-sixth of the entire length of the second resonator.

* * * * *